US011359569B2

(12) United States Patent
Miyamoto et al.

(10) Patent No.: US 11,359,569 B2
(45) Date of Patent: Jun. 14, 2022

(54) CONTROL UNIT OF FUEL INJECTION DEVICE

(71) Applicant: Hitachi Astemo, Ltd., Hitachinaka (JP)

(72) Inventors: Akiyasu Miyamoto, Tokyo (JP); Takao Miyake, Hitachinaka (JP); Ryo Kusakabe, Tokyo (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/289,782

(22) PCT Filed: Oct. 11, 2019

(86) PCT No.: PCT/JP2019/040167
§ 371 (c)(1),
(2) Date: Apr. 29, 2021

(87) PCT Pub. No.: WO2020/100485
PCT Pub. Date: May 22, 2020

(65) Prior Publication Data

US 2021/0396191 A1 Dec. 23, 2021

(30) Foreign Application Priority Data

Nov. 12, 2018 (JP) ..... JP2018-212106

(51) Int. Cl.
*F02D 41/20* (2006.01)
*F02D 41/24* (2006.01)
(Continued)

(52) U.S. Cl.
CPC ..... *F02D 41/20* (2013.01); *F02D 41/2487* (2013.01); *F02M 51/061* (2013.01); *F02M 61/1893* (2013.01)

(58) Field of Classification Search
CPC ... F02D 41/20; F02D 41/2487; F02M 51/061; F02M 61/1893
See application file for complete search history.

(56) References Cited

U.S. PATENT DOCUMENTS 4,590,907 A * 5/1986 Tsukamoto ..... F02D 41/408 123/357
4,817,571 A * 4/1989 Morita ..... F02D 41/10 123/492
(Continued)

FOREIGN PATENT DOCUMENTS

DE 10 2008 043 166 A1 4/2010
JP 2016-23619 A 2/2016
(Continued)

OTHER PUBLICATIONS

International Search Report (PCT/ISA/210) issued in PCT Application No. PCT/JP2019/040167 dated Jan. 7, 2020 with English translation (four (4) pages).
(Continued)

*Primary Examiner* — Joseph J Dallo
(74) *Attorney, Agent, or Firm* — Crowell & Moring LLP

(57) ABSTRACT

An object of the present invention is to promote the stabilization of the fuel injection amount in a fuel injection device in which a valve body and a movable iron core are configured to be relatively displaceable. In a control unit 120 of a fuel injection device 100 which includes a control part that controls the energization time of a current flowing through a coil 108 based on the pulse width of a drive command pulse, the control part is configured to be able to execute control to split a required fuel injection amount for one combustion cycle into portions and inject the portions in a plurality of times. In addition, in injections including a sequence of a preceding drive command pulse Pi1 and a subsequent drive command pulse Pi2, the control part acquires a preceding drive command pulse width Ti1 of the preceding drive command pulse Pi1 and a pulse interval Tint that is the time between the end time te1 of the preceding drive command pulse Pi1 and the start time ts2 of the subsequent drive command pulse Pi2, and corrects the
(Continued)

subsequent drive command pulse width Ti2 of the subsequent drive command pulse Pi2 by using the preceding drive command pulse width Ti1 and the pulse interval Tint.

7 Claims, 8 Drawing Sheets

(51) Int. Cl.
*F02M 51/06* (2006.01)
*F02M 61/18* (2006.01)

(56) References Cited

U.S. PATENT DOCUMENTS 4,903,657 A * 2/1990 Miyazaki ..... F02D 41/04 123/339.14
5,050,084 A * 9/1991 Nakaniwa ..... F02D 41/107 701/110
5,375,575 A * 12/1994 Ohishi ..... F02M 57/02 123/446
5,462,039 A * 10/1995 Mamiya ..... F02D 41/024 123/686
6,165,101 A * 12/2000 Takizawa ..... F16H 61/6648 477/37
6,244,241 B1 * 6/2001 Mamiya ..... F02D 41/2461 123/295
6,292,730 B1 * 9/2001 Takizawa ..... F16H 61/6648 477/68
7,500,471 B2 * 3/2009 Adachi ..... F02D 31/007 123/436
9,500,154 B2 * 11/2016 Li ..... F02D 41/1497
2002/0195081 A1 12/2002 McGee et al.
2009/0082946 A1 * 3/2009 Ishizuka ..... F02D 41/247 701/106
2011/0120423 A1 * 5/2011 Borchsenius ..... F02D 41/34 123/494
2011/0180044 A1 * 7/2011 Fritsch ..... F02D 41/2096 123/478
2012/0303245 A1 * 11/2012 Wang ..... F02D 41/0025 701/104
2014/0060488 A1 * 3/2014 Katzenberger ..... H02N 2/065 123/456
2017/0191441 A1 7/2017 Hashimoto et al.
2017/0226950 A1 * 8/2017 Tanaka ..... F02D 41/20
2018/0058367 A1 * 3/2018 Ottikkutti ..... F02D 41/403
2019/0211767 A1 7/2019 Miyake et al.
2019/0242323 A1 * 8/2019 Nishigaki ..... F02D 41/30
2021/0017928 A1 * 1/2021 Thomas ..... F02D 41/2451

FOREIGN PATENT DOCUMENTS

JP 2016-211468 A 12/2016
JP 2017-2861 A 1/2017
WO WO 2018/037734 A1 3/2018

OTHER PUBLICATIONS

Japanese-language Written Opinion (PCT/ISA/237) issued in PCT Application No. PCT/JP2019/040167 dated Jan. 7, 2020 (three (3) pages).

* cited by examiner

CONTROL UNIT OF FUEL INJECTION DEVICE

TECHNICAL FIELD

The present invention relates to a control unit that controls the fuel injection amount of a fuel injection device used in an internal combustion engine.

BACKGROUND ART

As a background art in this technical field, a control unit of a fuel injection device described in WO 2018/037734 A (PTL 1) is known. The fuel injection device in PTL 1 divides a mover into an outer diameter side mover and an inner diameter side mover. After the outer diameter side mover and the inner diameter side mover take a run-up to displace a gap, which is called a preliminary stroke, when the solenoid is energized, the inner diameter side mover collides with the flange of the valve body. In this fuel injection device, the kinetic energy stored in the outer diameter side mover and the inner diameter side mover during the run-up period is used for the valve opening operation of the valve body, so as to improve the responsiveness of the valve opening operation.

CITATION LIST

Patent Literature

PTL 1: WO 2018/037734 A

SUMMARY OF INVENTION

Technical Problem

In the fuel injection device in PTL 1, the outer diameter side mover and the inner diameter side mover (hereinafter referred to as a movable iron core) continue to be displaced downward after the valve is closed, and then turn upward to return to the valve closing standby state.

At this time, if an injection pulse, which is a drive signal for the fuel injection device, is turned on while the movable iron core is displaced downward or upward, the length of the gap in which the movable iron core takes a run-up change. In addition, the movable iron core has a velocity (kinetic energy), the valve opening behavior of the valve body is not stable, resulting in an unwanted increase in variation in the fuel injection amount. Such a problem is common not only to a fuel injection device in which the preliminary stroke of the movable iron core is configured, but also to a fuel injection device in which the valve body and the movable iron core are configured to be relatively displaceable.

An object of the present invention is to promote the stabilization of the fuel injection amount in a fuel injection device in which the valve body and the movable iron core are configured to be relatively displaceable.

Solution to Problem

In a control unit of a fuel injection device including a valve body that opens a fuel passage by moving away from a valve seat, a movable iron core that opens and closes the valve body, and a fixed iron core that attracts the movable iron core by passing a drive current through a coil, the control unit of the fuel injection device including a control part that controls an energization time of the drive current based on a pulse width of a drive command pulse, in which the control part is configured to be able to execute control to split a required fuel injection amount for one combustion cycle into portions and inject the portions in a plurality of times, and in a plurality of injections including a sequence of a preceding drive command pulse and a subsequent drive command pulse, the control part acquires a preceding drive command pulse width of the preceding drive command pulse and a pulse interval that is a time between an end time of the preceding drive command pulse and a start time of the subsequent drive command pulse, and corrects the subsequent drive command pulse width of the subsequent drive command pulse by using a preceding drive command pulse width and the pulse interval.

Advantageous Effects of Invention

According to the present invention, it is possible to promote the stabilization of the fuel injection amount in the fuel injection device in which the valve body and the movable iron core are configured to be relatively displaceable. Problems, configurations, and effects other than those described above will be clarified by the following description of embodiments.

DESCRIPTION OF EMBODIMENTS

Embodiments of the present invention will be described below.

Figure 1:
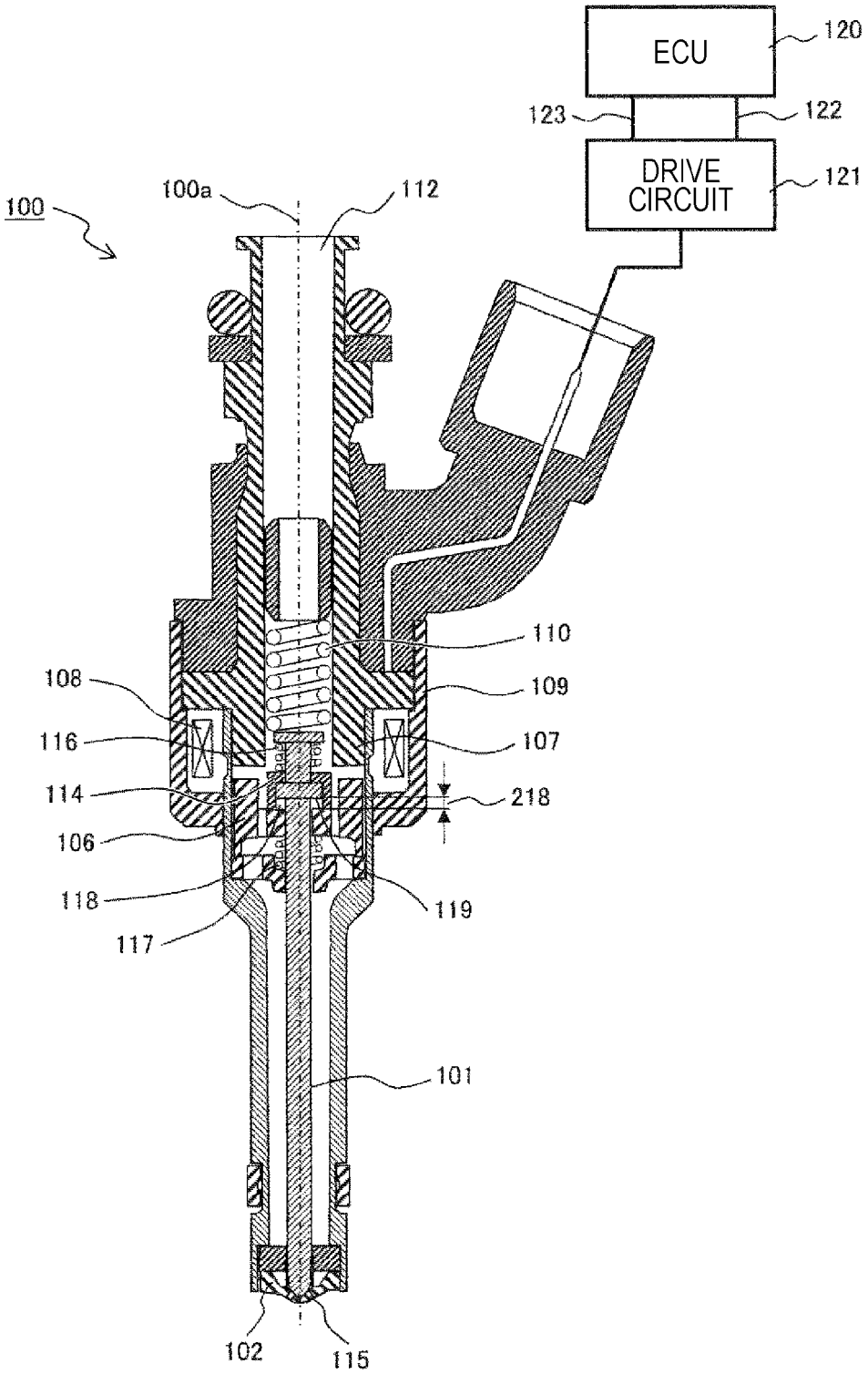
FIG. 1 is a cross-sectional view showing an embodiment of a fuel injection device 100 according to an embodiment of the present invention.
Figure 2A:
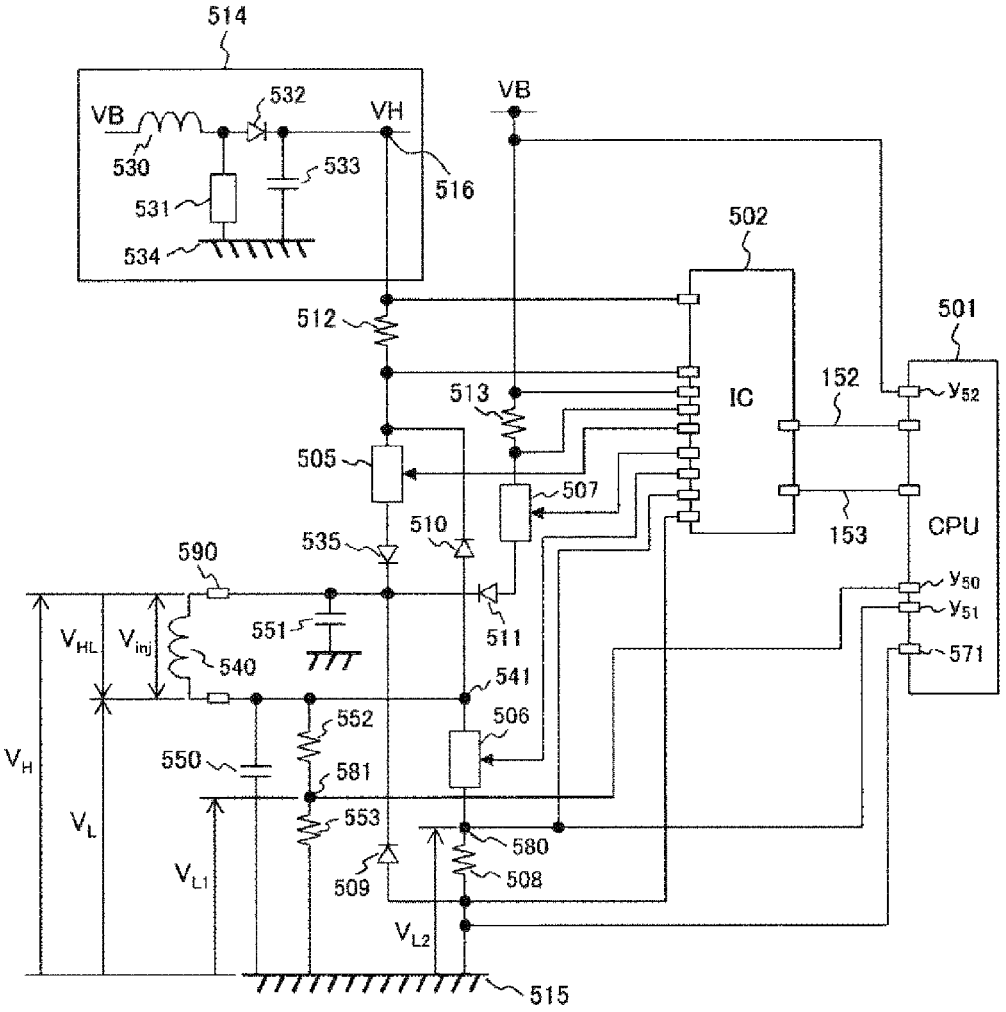
FIG. 2A is a circuit diagram showing the details of a drive circuit 121 and an engine control unit (ECU) 120 of the fuel injection device 100 according to an embodiment of the present invention.
Figure 2B:
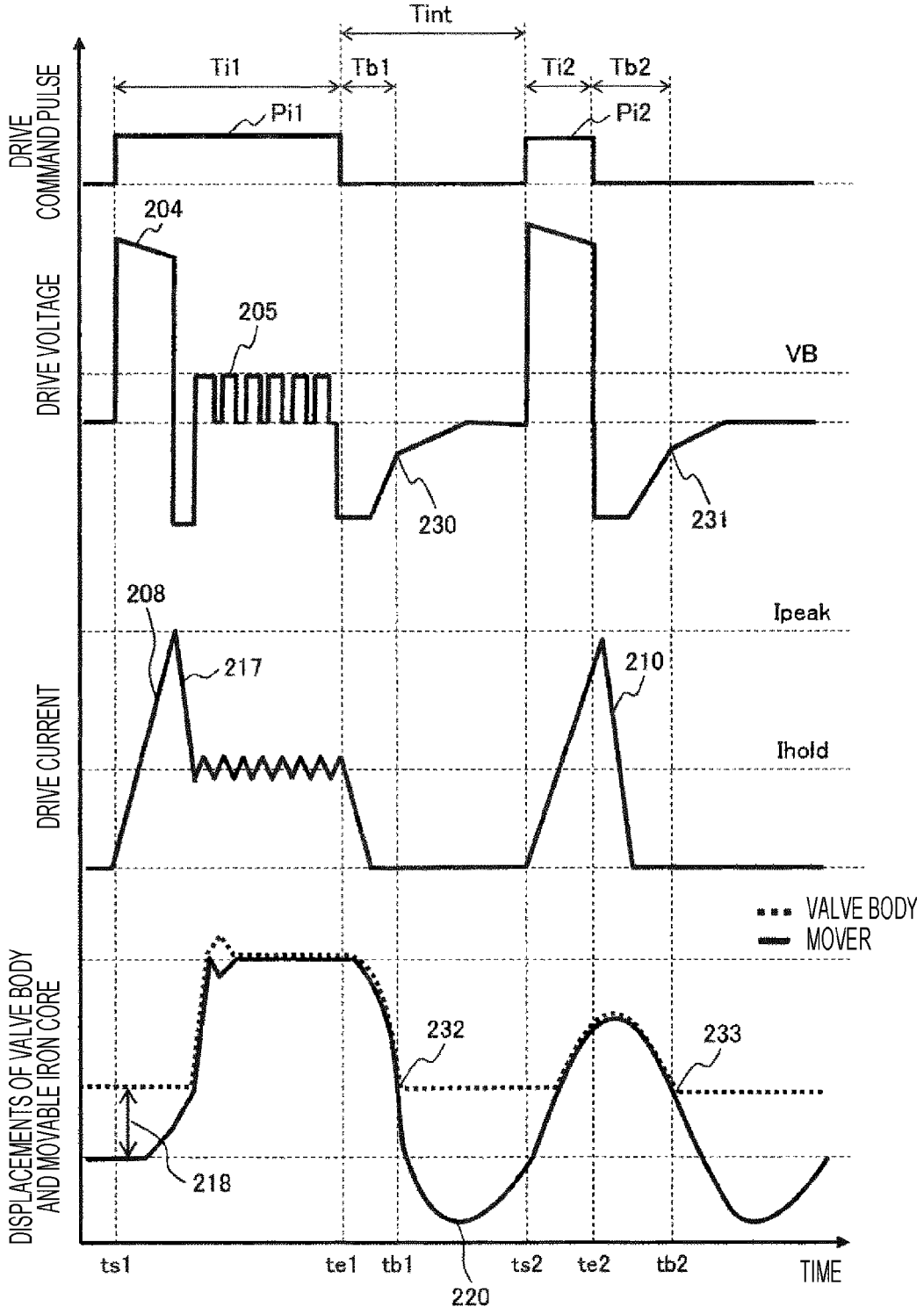
FIG. 2B is a graph showing drive command pulses (injection pulses) Pi1 and Pi2, drive voltage, drive current, valve body displacement, and movable iron core displacement in the fuel injection device 100 according to an embodiment of the present invention.

The configurations and operations of a fuel injection device 100 and a drive circuit 121 according to an embodiment of the present invention will be described with reference to FIGS. 1, 2A, and 2B. FIG. 1 is a cross-sectional view showing an embodiment of the fuel injection device 100 according to an embodiment of the present invention. FIG. 2A is a circuit diagram showing the details of the drive circuit 121 and an engine control unit (ECU) 120 of the fuel injection device 100 according to an embodiment of the present invention. FIG. 2B is a graph showing drive command pulses (injection pulses) Pi1 and Pi2, drive voltage, drive current, valve body displacement, and movable iron core displacement in the fuel injection device 100 according to an embodiment of the present invention.

The configuration of the fuel injection device 100 will be described first with reference to FIG. 1.

The fuel injection device 100 includes a fuel supply part 112 for supplying fuel, a valve seat 102 having a fuel injection hole 115 serving as a fuel passage, and a movable iron core 106 for driving a valve body 101. In this embodiment, an electromagnetic fuel injection device for an internal combustion engine using gasoline as a fuel will be described as an example.

In the fuel injection device 100 according to this embodiment, the fuel supply part 112 is formed on the upper end side of FIG. 1, the fuel injection hole 115 and the valve seat 102 are formed on the lower end side, and the movable iron core 106, the valve body 101, and an intermediate member 114 are formed between the fuel supply part 112 and the valve seat 102.

An end portion of the fuel injection device 100 which is located on the opposite side (on the fuel supply part 112 side) to the fuel injection hole 115 and the valve seat 102 is coupled to a fuel pipe (not shown). An end portion of the fuel injection device 100 which is located on the opposite side (fuel injection hole 115 side) to the fuel supply part 112 is inserted into a mounting hole (insertion hole) formed in an intake pipe (not shown) or a combustion chamber forming member (a cylinder block, a cylinder head, and the like) of the internal combustion engine. The fuel injection device 100 receives fuel from the fuel pipe through the fuel supply part 112, and injects fuel from the distal end portion of the valve seat 102 into the intake pipe or the combustion chamber. Inside the fuel injection device 100, a fuel passage is formed to make fuel flow, from the proximal end portion on the fuel supply part 112 side to the distal end portion on the fuel injection hole 115 side, substantially along a central axis 100*a* of the electromagnetic fuel injection device 100.

The drive circuit (EDU) 121 and the engine control unit (ECU) 120 for driving the fuel injection device 100 are connected to the fuel injection device 100. The EDU 121 is a circuit that receives a drive command pulse (injection pulse) from the ECU 120 and energizes the fuel injection device 100 with a drive current (drive voltage). The ECU 120 and the EDU 121 may be configured as an integral component. At least the EDU 121 is a device that generates a drive voltage for the fuel injection device 100. The EDU 121 may be integrated with the ECU 120, or may be formed of an EDU alone.

The ECU 120 takes in signals indicating the state of the engine from various sensors and calculates an appropriate drive command pulse width and injection timing in accordance with the operating conditions of the internal combustion engine. The drive command pulses Pi1 and Pi2 output from the ECU 120 are input to the EDU 121 through a signal line 123.

The EDU121 controls the drive voltage applied to a coil 108 and supplies the drive current. The ECU 120 communicates with the EDU 121 through a communication line 122, and can switch the drive current generated by the EDU 121 depending on the pressure of the fuel supplied to the fuel injection device 100 and the operating conditions. The EDU 121 can change a control constant by communicating with the ECU120. The current waveform changes in accordance with the control constant.

The configuration of the drive device 121 will be described next with reference to FIG. 2A.

A CPU 501 is, for example, built in the ECU 120, and takes in signals indicating the state of the engine from the various sensors described above, such as a pressure sensor attached to the fuel pipe upstream of the fuel injection device 100, an A/F sensor that measures the amount of air flowing into the engine cylinder, an oxygen sensor for detecting the oxygen concentration of exhaust gas discharged from the engine cylinder, and a crank angle sensor.

In accordance with these signals, the CPU 501 calculates the widths and injection timings of drive command pulses (injection pulse) for controlling the amount of fuel injected from the fuel injection device 100 according to the operating conditions of the internal combustion engine. Further, the CPU 501 calculates pulse widths Ti1 and Ti2 and injection timings ti1 and ti2 of the drive command pulses Pi1 and Pi2 appropriately in accordance with the operating conditions of the internal combustion engine, and outputs the drive command pulses to a drive IC 502 of the fuel injection device 100 via a signal line 153. The magnitude of the injection amount is determined by the magnitudes of the pulse widths Ti1 and Ti2 of the drive command pulses Pi1 and Pi2. After that, the drive IC 502 switches between energization and de-energization of switching elements 505, 506, and 507 to supply a drive current to the fuel injection device 100.

The switching element 505 is connected between a higher voltage source higher than a voltage source VB input to the drive circuit 121 and a terminal on the high voltage side of a solenoid 540 of the fuel injection device 100. The switching elements 505, 506, and 507 are configured by, for example, FETs, transistors, and the like, and can switch between energization and de-energization of the fuel injection device 100. A boost voltage VH, which is the initial voltage value of the high voltage source, is, for example, 65 V, and is generated by boosting the battery voltage by a boost circuit 514. The boost circuit 514 may be configured by, for example, a DC/DC converter or the like, or may be configured by a coil 530, a transistor 531, a diode 532, and a capacitor 533. In the case of the latter boost circuit 514, when the transistor 531 is turned on, the battery voltage VB flows to the ground potential 534 side, whereas when the transistor 531 is turned off, the high voltage generated in the coil 530 is statically flowed through the diode 532, and charge is accumulated in the capacitor 533. This transistor is repeatedly turned on and off until the boost voltage VH is obtained, and the voltage of the capacitor 533 is increased. The transistor 531 is connected to the IC 502 or the CPU 501, and the boost voltage VH output from the boost circuit 514 is configured to be detected by the IC 502 or the CPU 501.

Further, the switching element 507 is connected between the low voltage source and the high voltage terminal of the solenoid 540. The low voltage source VB is, for example, a battery voltage, whose voltage value is about 12 V to 14 V. The switching element 506 is connected between the low voltage terminal of the fuel injection device 100 and a ground potential 515. The drive IC 502 detects current values flowing through the fuel injection device 100 by current detection resistors 508, 512, and 513, and switches between energization and de-energization of the switching elements 505, 506, and 507 in accordance with detected current values, thereby producing desired drive currents. Diodes 509 and 510 are provided to apply a reverse voltage to the solenoid 540 of the fuel injection device 100 to rapidly reduce the current supplied to the solenoid 540. The CPU 501 communicates with the drive IC 502 through a communication line 152, and can switch the drive current generated by the drive IC 502 depending on the pressure of the fuel supplied to the fuel injection device 100 and the operating conditions. Further, both ends of resistors 508, 512, and 513 are connected to the A/D conversion port of IC 502, and the voltage applied to both ends of resistors 508, 512, and 513 can be detected by IC 502.

In this embodiment, when performing the split injection, the ECU 120 sometimes transmits a control constant to the EDU121 to cause the EDU 121 to correct the pulse width Ti2 of the drive command pulse Pi2 for the second injection in order to correct the pulse width Ti2 of the drive command pulse (the next drive command pulse and the second drive command pulse) Pi2 of the next injection (second injection).

The operation of the fuel injection device 100 will be described next with reference to FIG. 2B.

In the valve closed state in which the coil 108 is not energized, the valve body 101 is in contact with the valve seat 102 with the force obtained by subtracting the urging force of a third spring member 117 from the urging force of a first spring member 110 and a second spring member 116 that urge the valve body 101 in the valve closing direction. This state is defined as a valve closing stable state (valve closing standby state). In the valve closed stable state, the movable iron core 106 is in contact with the intermediate member 114 and is placed at the valve closed position. The valve body 101 is driven via a transmission surface 119 that transmits a load from the movable iron core 106.

In the valve closed stable state, the intermediate member 114 is urged to the downstream side (the valve seat 115 side and the valve closing direction) by the second spring member 116, is in contact with the valve body 101, and is stationary. The movable iron core 106 is urged to the upstream side (a fixed iron core 107 side and the valve opening direction) by the third spring member 116, and is in contact with the intermediate member 114. Since the urging force of the second spring member 116 is larger than the urging force of the third spring member 117, a gap 218 is formed between the valve body 101 and the movable iron core 106.

An operation after energization will be described next.

When the drive command pulse (the pre-drive command pulse and the first drive command pulse) Pi1 voltage 204 is applied from the high voltage source boosted to a voltage higher than the battery voltage VB is applied, and current supply to the coil 108 is started. After the coil 108 is energized, a magnetomotive force is generated by the electromagnet composed of the fixed iron core 107, the coil 108, and a housing 109. This magnetomotive force makes a magnetic flux flow around the magnetic path formed by the fixed iron core 107, the housing 109, and the movable iron core 106 so as to surround the coil 108. At this time, a magnetic attraction force acts between the movable iron core 106 and the fixed iron core 107, and the movable iron core 106 and the intermediate member 114 are displaced toward the fixed iron core 107. After that, the movable iron core 106 is displaced until the transmission surface 119 of the valve body 101 and a transmission surface 118 of the movable iron core 106 come into contact with each other. The valve body 101 continues to maintain the contact state with the valve seat 102.

When the movable iron core 106 is displaced by the gap 218 formed between the valve body 101 and the movable iron core 106 and the transmission surface 119 of the valve body 101 collides with the transmission surface 118 of the movable iron core 106, the valve body 101 is pulled upstream by the energy of the iron core 106 and separated from the valve seat 102. As a result, a gap is formed in the valve seat portion, a fuel passage is opened, and fuel is injected from the fuel injection hole 115. The valve body 101 is steeply displaced by the movable iron core 106 having kinetic energy.

When the movable iron core 106 comes into contact with the fixed iron core 107, the valve body 101 is displaced upstream and the movable iron core 106 is displaced downward. When the fixed iron core 107 and the movable iron core 106 collide with each other, the valve body 101 and the movable iron core 106 are separated from each other, and the movable iron core 106 is displaced to the downstream side. The movable iron core 106 eventually becomes stationary and stable at a target lift position. This state is defined as a valve opening stable state.

On the other hand, the current value rises steeply as indicated by reference numeral 208 by the application of the high voltage 204. When the current value reaches a predetermined peak current value Ipeak, the application of the high voltage 204 is stopped to reduce the applied voltage to 0V or less, thereby reducing the current value as indicated by a current profile 217. After that, the application of the battery voltage VB and the application of 0 V are repeated (205), and control is performed to obtain a hold current value Ihold.

Subsequently, when the drive command pulse Pi1 is turned off at time te1, the current supply to the coil 108 is cut off, and the magnetic flux generated in the magnetic circuit disappears. Consequently, the magnetic attraction force also disappears.

As a result, the movable iron core 106 that has lost the magnetic attraction force is pushed back to the closed position where the valve body 101 contacts the valve seat 102 by the load of the first spring member 110 and the force originating from the fuel pressure. The force of the first spring member 110 acting on the valve body 101 is transmitted to the movable iron core 106 via the transmission surface 119 on the valve body 101 side and the transmission surface 118 on the movable iron core 106 side. When a valve closing completion time (required valve closing time) Tb1 from time te1, at which the first drive command pulse Pi1 is turned off, to time tb1, at which the valve closing is completed, the valve body 101 contacts the valve seat 102 at time tb1. After the valve body 101 comes into contact with the valve seat 102, the transmission surface 118 on the movable iron core 106 side separates from the transmission surface 119 on the valve body 101 side and continues to move in the downward direction (valve closing direction). After time tb1 at which the valve closing is completed, the movable iron core 106 and the valve body 101 are separated from each other as indicated by reference numeral 232. At this time, as indicated by reference numeral 230, the drive voltage changes like bending. From this change, tb1 and Tb1 can be detected.

Like a movable iron core profile 220 after valve closing, the movable iron core 106 is pushed back by the third spring member 117. Eventually, the movable iron core 106 and the intermediate member 114 re-collide with each other. When the upward force (in the valve opening direction) acting on the movable iron core 106 at the time of re-collision is larger than the downward force acting on the valve body 101, the intermediate member 114 is pushed up and the gap 218 between the valve body 101 and the movable iron core 106 becomes smaller.

When the second drive command pulse Pi2 of the next injection (second injection) is turned ON while the gap 218 is smaller than when the valve is closed and stable, a sufficient approach distance cannot be obtained. This sometimes reduces the speed of the movable iron core 106 when the valve body 101 opens, and causes a change in the injection amount. On the other hand, when the second drive command pulse Pi2 is turned on while the gap 218 is larger than in the valve closed stable state (time ts2), the approach distance becomes too large. Due to this effect, the opening speed of the valve body 101 sometimes increases to cause a change in the injection amount.

In this way, since the movable iron core 106 continues to move after the valve body 101 collides with the valve seat 102, when the next drive command pulse Pi2 is turned ON while the gap 218 between the movable iron core 106 and the valve body 101 has changed, the behavior of the valve body 101 changes in accordance with the variation in the position and speed of the movable iron core 106, and the injection amount changes.

After a certain period of time elapses from the first drive command pulse Pi1, the movable iron core 106 is set in the valve closed stable state again, and the behavior of the valve body 101 is stabilized.

Therefore, in order to control the injection amount based on the first drive command pulse Pi1 and the second drive command pulse Pi2 to a desired amount, it is necessary to use a control method in consideration of the gap and speed between the movable iron core 106 and the valve body 101 after valve closing are taken into consideration.

Figure 6:
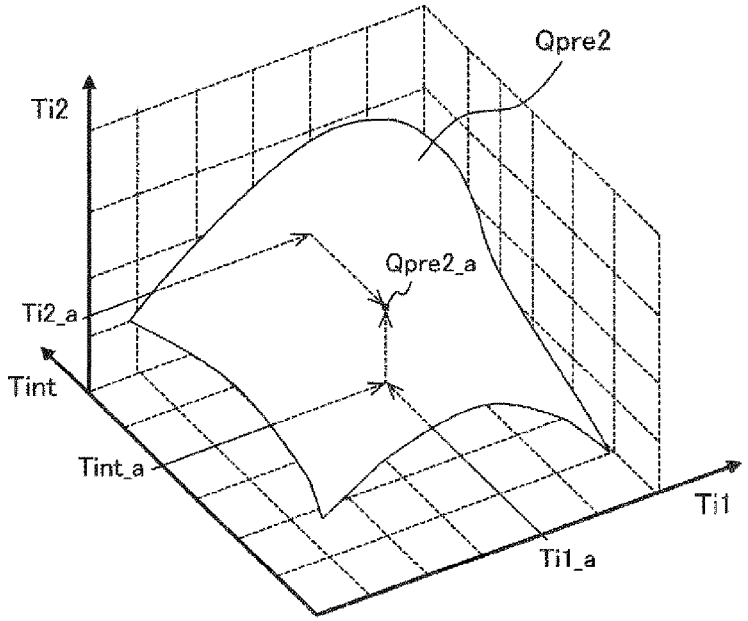
FIG. 6 is a map showing the relationship between a first drive command pulse width Ti1, the second drive command pulse width Ti2, the pulse interval Tint between the first drive command pulse Pi1 and the second drive command pulse Pi2, and a second injection amount predicted value Qpre2 in the second drive command pulse Pi2, in the engine control unit 120 according to the first embodiment of the present invention.
Figure 7:
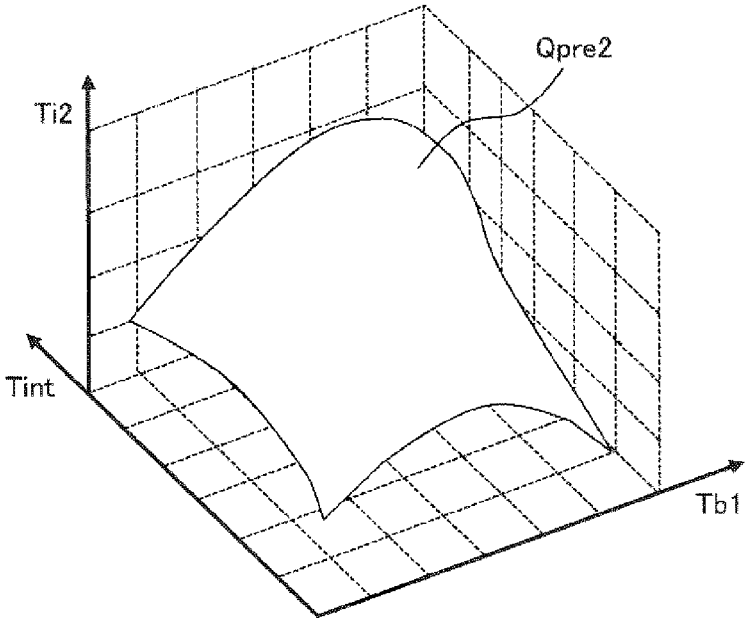
FIG. 7 is a map showing the relationship between a valve closing completion time Tb1 in a first drive command pulse Pi1, a second drive command pulse width Ti2, a pulse interval Tint between the first drive command pulse Pi1 and a second drive command pulse Pi2, and a second injection amount predicted value Qpre2 in the second drive command pulse Pi2 in an engine control unit 100 according to the second embodiment of the present invention.

Therefore, in the configuration of this embodiment, in order to set the second injection amount based on the second drive command pulse Pi2 to a desired injection amount, the second drive command pulse width Ti2 as a correction target, the first drive command pulse width Ti1, a time interval Tint between the first drive command pulse Pi1 and the second drive command pulse Pi2, and a predicted value Qpre2 of the second injection amount based on the second injection pulse Pi2 are acquired in advance as characteristic data, and a correction amount ΔTi2 for correcting the second drive command pulse width Ti2 is calculated by using the acquired characteristic data (FIG. 6 or 7).

Further, the characteristic data is updated by the time Tb1 required for the valve body 101 to close the valve in response to the first drive command pulse width Ti1. In addition, the characteristic data holds the valve closing completion time tb2 or valve closing completion time (time from te2 to tb2) Tb2 acquired after injection as a learning value, and the second injection amount predicted value Qpre2 is updated by using this learning value to be used at the time of the next multi-stage injection. After time tb2 at which the valve closing is completed in the second drive command pulse Pi2, the movable iron core 106 and the valve body 101 are separated from each other, and at this time, the drive voltage has a change like bending, as indicated by reference numeral 230. From this change, tb2 and Tb2 can be detected.

Figure 3A:
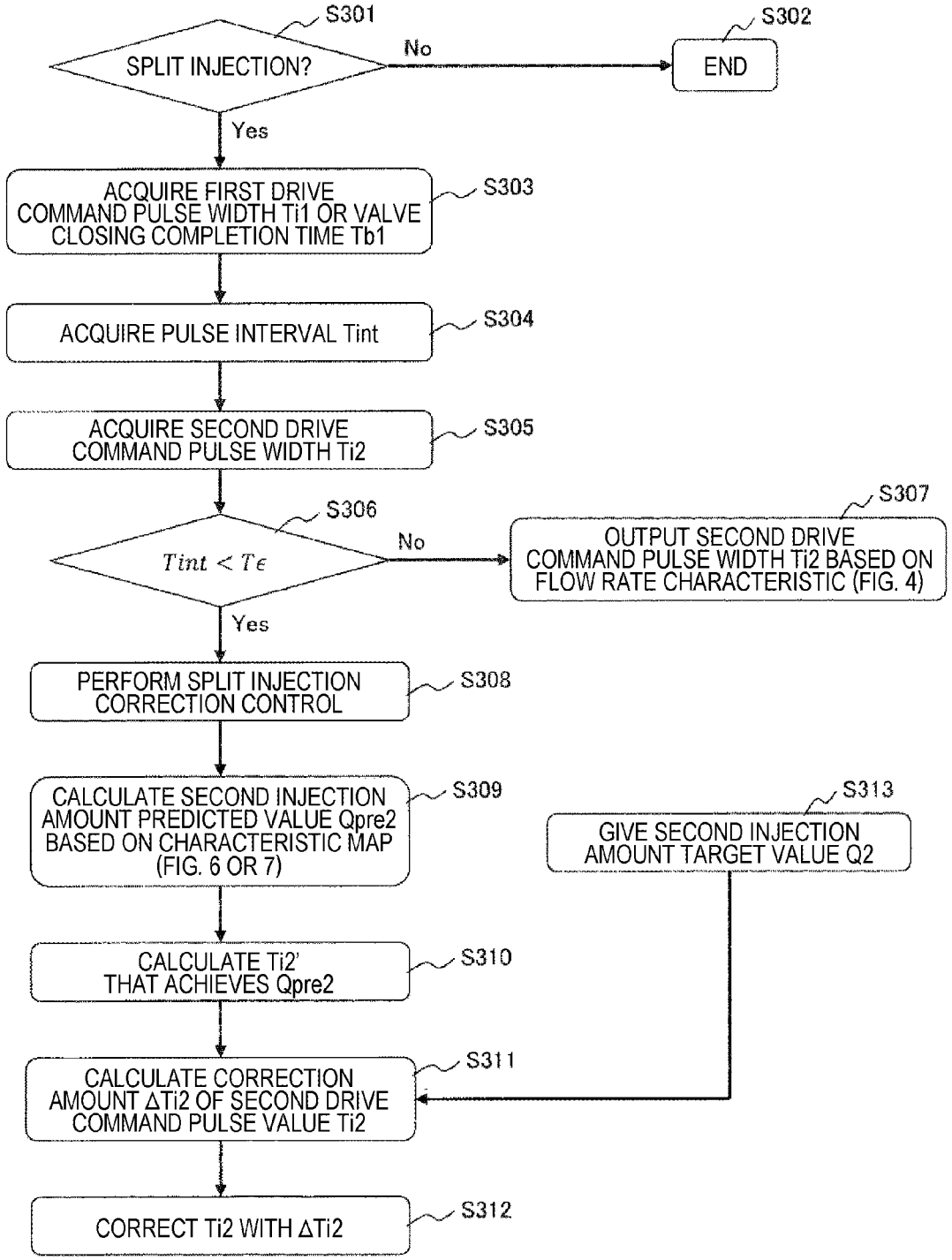
FIG. 3A is a control flowchart according to an embodiment of the present invention.
Figure 3B:
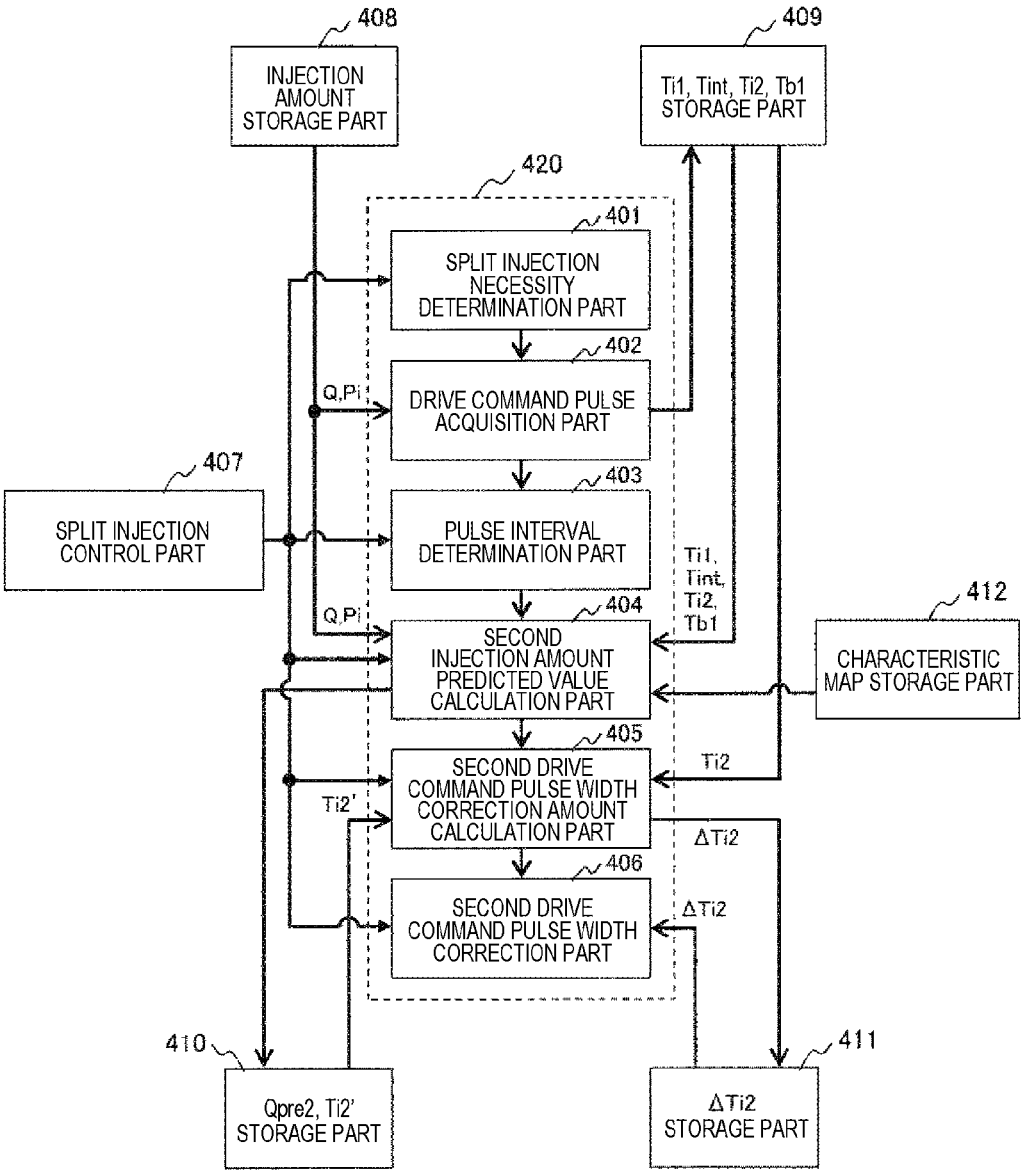
FIG. 3B is a block diagram showing a main function of the engine control unit 120 according to an embodiment of the present invention.

FIG. 3A is a control flowchart according to an embodiment of the present invention. FIG. 3B is a block diagram showing a main function of the engine control unit 120 according to an embodiment of the present invention.

Figure 4:
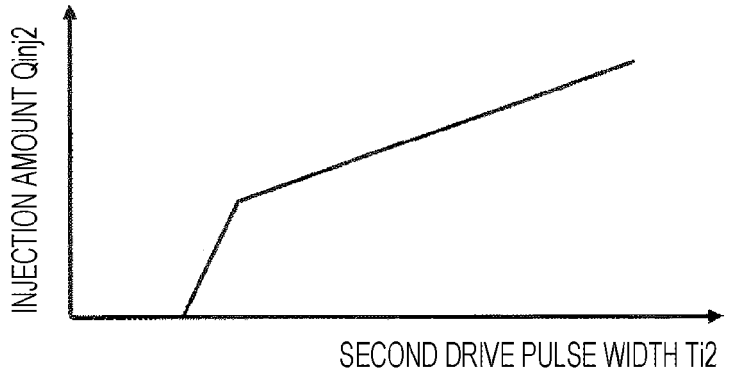
FIG. 4 is a map showing the relationship between a second drive command pulse width Ti2 and a second injection amount Qinj2 in the second drive command pulse Pi2 in the fuel injection device 100 according to an embodiment of the present invention.

The ECU 120 is configured to correct the second drive command pulse width Ti2 at the time of split injection when the injection interval Tint of the fuel injection device 100 is less than a first set value Tε. Split injection means an injection method of splitting the fuel injection amount required for one combustion cycle into portions and injecting the portions in a plurality of times. When the injection interval Tint is equal to or greater than the set value Tε, the second drive command pulse width Ti2 is output based on the relationship between an injection amount (second injection amount) Qinj2 and the second drive command pulse width Ti2 by using the flow rate characteristic data (FIG. 4) acquired in advance. FIG. 4 is a map showing the relationship between the second drive command pulse width Ti2 and the second injection amount Qinj2 in the second drive command pulse Pi2 in the fuel injection device 100 according to an embodiment of the present invention.

Figure 5:
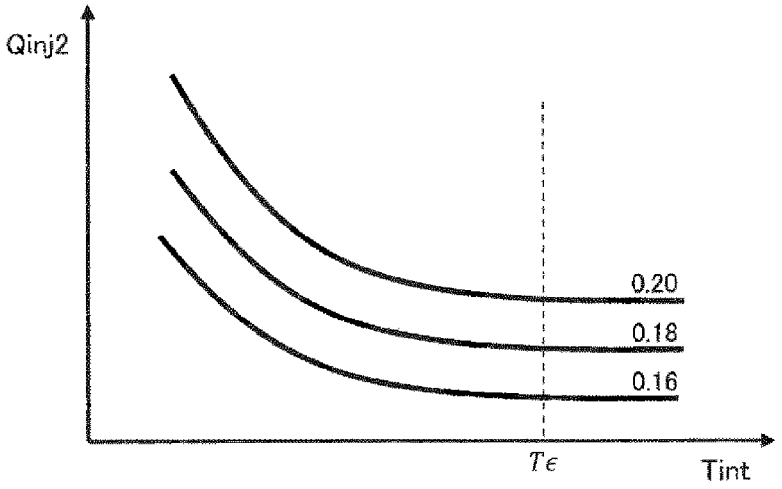
FIG. 5 is a graph showing the relationship between the second injection amount Qinj2 and an injection interval Tint in the fuel injection device 100 according to an embodiment of the present invention.

As shown in FIG. 5, the set value Tε is the time when the second injection amount Qinj2 converges in the relationship among the injection time Tint, the second injection amount Qinj2, and the second drive command pulse width Ti2. FIG. 5 is a graph showing the relationship between the second injection amount Qinj2 and an injection interval Tint in the fuel injection device 100 according to an embodiment of the present invention.

Specifically, the ECU 120 has functional parts 401 to 406 shown in the block diagram of FIG. 3B, and executes the process in FIG. 3A.

The split injection necessity determination part 401 determines the necessity of split injection in step 301. When it is determined that split injection is necessary, the drive command pulse acquisition part (injection pulse width acquisition part) 402 acquires the first drive command pulse width Ti1 (when using FIG. 6 described later), the pulse interval Tint, and the second drive command pulse width Ti2 in steps S303, S304, and S305, respectively. At this time, the drive command pulse acquisition part 402 may acquire the valve closing completion time Tb1 (when using FIG. 7 described later) in the first drive command pulse Pi1 instead of the first drive command pulse width Ti1. Information such as the first drive command pulse width Ti1, the valve closing completion time Tb1, the pulse interval Tint, and the second drive command pulse width Ti2 is stored in the storage part 409.

The drive command pulse acquisition part 402 acquires the valve closing completion time Tb1 by detecting the change point 230 of the drive voltage in FIG. 2B.

At this time, the drive command pulse acquisition part 402 refers, as appropriate, to the relationship between an injection amount Q stored in the injection amount storage part 408 and drive command pulses Pi (Pi1 and Pi2). The injection amount storage part 408 stores the value (requested value) of a target injection amount (injection amount target value) corresponding to drive command pulse widths such as the first drive command pulse width Ti1 and the second drive command pulse width Ti2 for each accelerator depression amount and engine speed. That is, from the relationship between the drive command pulse width and the injection amount target value stored in the injection amount storage part 408, the first drive command pulse width Ti1 corresponding to the injection amount (first injection amount target value) based on the first drive command pulse Pi1 can be acquired, and the second drive command pulse width Ti2 corresponding to the injection amount (second injection amount target value) based on the second drive command pulse Pi2 can be acquired.

If it is determined that split injection is unnecessary, processing after that in FIG. 3A is not performed, and the processing is terminated in step 302.

In step S306, the pulse interval determination part (injection interval determination part) 403 compares the injection interval Tint with the set value Tε. The set value Tε is a threshold value set in advance for determining the necessity of correcting the injection amount, that is, the necessity of correcting the second drive command pulse width Ti2. If the injection interval Tint is less than the set value Tε, the split injection control part 407 issues an instruction to start split injection correction control in step S308. When the injection interval Tint is equal to or greater than the set value Tε, the process shifts to step S307 for calculating the second drive command pulse width Ti2 from the flow rate characteristics shown in FIG. 4, and the second drive command pulse width Ti2 is not corrected. Since the block for executing step S307 is not related to the correction of the second drive command pulse width Ti2 in this embodiment, a description is omitted in FIG. 3B.

In step S309, in response to an instruction from a split injection control part 407, the second injection amount predicted value calculation part 404 calculates the second injection amount predicted value Qpre2 corresponding to the first drive command pulse width Ti1 (or valve closing completion time Tb1), the pulse interval Tint, and the second drive command pulse width Ti2 by using the characteristic map (FIG. 6 or 7) stored in a characteristic map storage part 412. A target injection amount Q2 corresponding to the second drive command pulse width Ti2 is given as the second injection amount target value in order to acquire the second drive command pulse width Ti2 (step S313).

Further, the second injection amount predicted value calculation part 404 calculates a second drive command pulse width Ti2' corresponding to the second injection amount predicted value Qpre2 in step S310. In this calculation, the second drive command pulse width Ti2' that makes the second injection amount predicted value Qpre2 become the target injection amount Q2 is calculated by using the relationship between the injection amount Q and the drive command pulses Pi (Pi1 and Pi2) stored in the injection amount storage part 408.

A characteristic map (FIG. 6 or 7) may be used in the calculation of the second drive command pulse width Ti2'. That is, a difference ΔQpre2 between Qpre2 and Q2 may be obtained by using the characteristic map to calculate ΔTi2 corresponding to ΔQpre2 and by using the first drive command pulse width Ti1 (or valve closing completion time Tb1) and the pulse interval Tint.

The characteristic map for calculating Qpre2 is stored in the characteristic map storage part 412 and updated as appropriate. As the characteristic map, either FIG. 6 or FIG. 7 may be stored, but both characteristic maps may be stored.

The second drive command pulse width Ti2' obtained in step S310 includes the influence of the behavior change of the valve body 101 that occurs in accordance with the variation in the position and speed of the movable iron core 106. The second injection amount predicted value Qpre2 and the second drive command pulse width Ti2' are stored in the storage part 410.

A second drive command pulse width correction amount calculation part 405 calculates the correction amount ΔTi2 of the second drive command pulse width in step S311. The correction amount ΔTi2 is calculated as the difference between the second drive command pulse width (target value) Ti2 corresponding to the second injection amount target value Q2 and the second drive command pulse width Ti2' corresponding to the second injection amount predicted value Qpre2. For example, the correction amount ΔTi2 is obtained by subtracting the second drive command pulse width Ti2' from the second drive command pulse width Ti2.

The second drive command pulse width correction part 406 then corrects the target value Ti2 of the second drive command pulse width based on the correction amount ΔTi2 in step S312.

When the correction amount ΔTi2 is a positive value, the target value Ti2 of the second drive command pulse width causes a shortage of time corresponding to the absolute value of the correction amount ΔTi2 for the injection of the target injection amount Q2. Therefore, the target value Ti2 of the second drive command pulse width is corrected by adding the absolute value of the correction amount ΔTi2 to the target value Ti2 of the second drive command pulse width.

When the correction amount ΔTi2 is a negative value, the target value Ti2 of the second drive command pulse width causes an excess of time corresponding to the absolute value of the correction amount ΔTi2 for the injection of the target injection amount Q2. Therefore, the target value Ti2 of the second drive command pulse width is corrected by subtracting the absolute value of the correction amount ΔTi2 from the target value Ti2 of the second drive command pulse width.

The functions of the blocks 401 to 406 described above are implemented by using an arithmetic processing unit 420 having a CPU and programs. The arithmetic processing unit 420 may include either a single CPU or a plurality of CPUs.

A method of calculating the second drive command pulse width Ti2' from the first drive command pulse width Ti1 and the pulse interval Tint will be described with reference to FIG. 6. FIG. 6 is a map showing the relationship between the first drive command pulse width Ti1, the second drive command pulse width Ti2, the pulse interval Tint between the first drive command pulse Pi1 and the second drive command pulse Pi2, and the second injection amount prediction value Qpre2 in the second drive command pulse Pi2 in the engine control unit 120 according to the first embodiment of the present invention.

As shown in FIG. 6, the characteristic map held inside the ECU 120 is a four-dimensional map of the first drive command pulse width Ti1, the pulse interval Tint, the second drive command pulse width Ti2, and the second injection amount predicted value Qpre2. This map is acquired in advance. A second injection amount predicted value Qpre2_a corresponding to a first drive command pulse width Ti1_a, a pulse interval Tint_a, and a second drive command pulse width Ti2_a acquired by the ECU 120 is calculated by using the four-dimensional characteristic map.

The first drive command pulse width Ti1 and the pulse interval Tint are important factors related to the behavior of the movable iron core 106, and the behavior of the movable iron core 106 can be predicted by using the first drive command pulse width Ti1 and the pulse interval Tint.

A method of calculating the second drive command pulse width Ti2' from the valve closing completion time Tb1 and the pulse interval Tint will be described with reference to FIG. 7. FIG. is a map showing the relationship between a valve closing completion time Tb1 in a first drive command pulse Pi1, a second drive command pulse width Ti2, a pulse interval Tint between a first drive command pulse Pi1 and a second drive command pulse Pi2, and a second injection amount prediction value Qpre2 in the second drive command pulse Pi2 in an engine control unit 100 according to the second embodiment of the present invention.

Instead of the characteristic map in FIG. 6, a second injection amount predicted value Qpre2_a can be calculated using the characteristic map in FIG. 7. Obviously, a second drive command pulse width Ti2' may be calculated using both the characteristic maps in FIGS. 6 and 7. When both the characteristic maps in FIGS. 6 and 7 are used, after the second injection amount predicted value Qpre2_a is calculated using both characteristic maps, one of the second injection amount predicted values Qpre2_a may be selected. Alternatively, the average of both second injection amount predicted values Qpre2_a may be taken.

An ECU 120 can detect an inflection point 230 (see FIG. 2B) by differentiating the drive voltage applied to a coil 108, detect the time tb1, at which a valve body 101 and a valve seat 102 of the fuel injection device 100 collide with each other, from time tb1 of the inflection point 230, and calculate the valve closing completion time Tb1. That is, the drive voltage applied to the coil 108 is acquired, the inductance change of the coil 108 is calculated from this drive voltage by a calculation part, and the movement of the valve body 101 is detected by a detection part using the calculation result of the calculation part. In this case, the calculation part and the detection part may be configured into a drive command pulse acquisition part 402 in FIG. 3B.

The characteristic map in FIG. 7 is a four-dimensional map of the valve closing completion time Tb1 corresponding to the first drive command pulse width Ti1, the pulse interval Tint, the second drive command pulse width Ti2, and the second injection amount predicted value Qpre2.

The characteristic map in FIG. 6 is the same as that in FIG. 7 except that the first drive command pulse width Ti1 is replaced with the valve closing completion time Tb1, and hence the calculation method for the second drive command pulse width Ti2' can be explained with reference to the characteristic map in FIG. 7 by replacing the first drive command pulse width Ti1 described in FIG. 6 with the valve closing completion time Tb1.

The valve closing completion time Tb1 and the pulse interval Tint are important factors related to the behavior of a movable iron core 106, and the behavior of the movable iron core 106 can be predicted by using the valve closing completion time Tb1 and the pulse interval Tint.

By correcting the second drive command pulse width Ti2 by the difference between the second injection amount predicted value Qpre2 and the second injection amount target value Q2, the variation of the fuel injection device 100 for each individual and the characteristic change due to aging deterioration can be corrected. In addition, aging deterioration and differences in characteristics of individuals can be corrected by holding the valve closing completion time Tb2 acquired after the injection of the second injection pulse width Ti2 as a learning value and correcting the second injection amount predicted value Qpre2 by using this learning value. The detection part for detecting the valve closing completion time Tb2 may be configured into the drive command pulse acquisition part 402 as in the case of the valve closing completion time Tb1.

The characteristic map is updated using the valve closing completion time Tb2 of the next injection detected by the drive command pulse acquisition part 402.

In this embodiment, a four-dimensional map acquired in advance is used to obtain the relationship among the first drive command pulse width Ti1, the pulse interval Tint, the second drive command pulse width Ti2, and the second injection amount predicted value Qpre2. However, the above-mentioned actions and effects can be obtained by using the physical model calculated inside the ECU 120 and the learning values learned when the engine is running.

Further, the first drive command pulse Pi1 and the second drive command pulse Pi2 are output during one injection stroke. That is, in this embodiment, the amount of fuel to be injected during one injection stroke is spit into a plurality of portions and injected in a plurality of times, including at least the drive command pulses Pi1 and Pi2. The "one injection stroke" means one combustion cycle (four cycles consist of intake, compression, explosion, and exhaust strokes).

The correction amount ΔTi2 for correcting the second drive command pulse width Ti2 is calculated by acquiring, in advance, the relationship among the second drive command pulse width Ti2 to be corrected, the first drive command pulse width Ti1, the pulse interval Tint between the first drive command pulse width Ti1 and the second drive command pulse width Ti2, and the time Tb1 (the time from when the current is cut to when the valve is closed) required for valve closing at the time of the first drive command pulse width Ti1 and using the acquired characteristic data. This makes it possible to suppress the variation in the motion of the valve body 101 due to the variation in the motion of the movable iron core 106. This suppresses the increase/decrease in the injection amount with respect to the second drive command pulse width Ti2 due to the variation in the motion of the movable iron core 106 and the valve body 101, and can stably supply a desired injection amount (target injection amount) to the engine.

Figure 8:
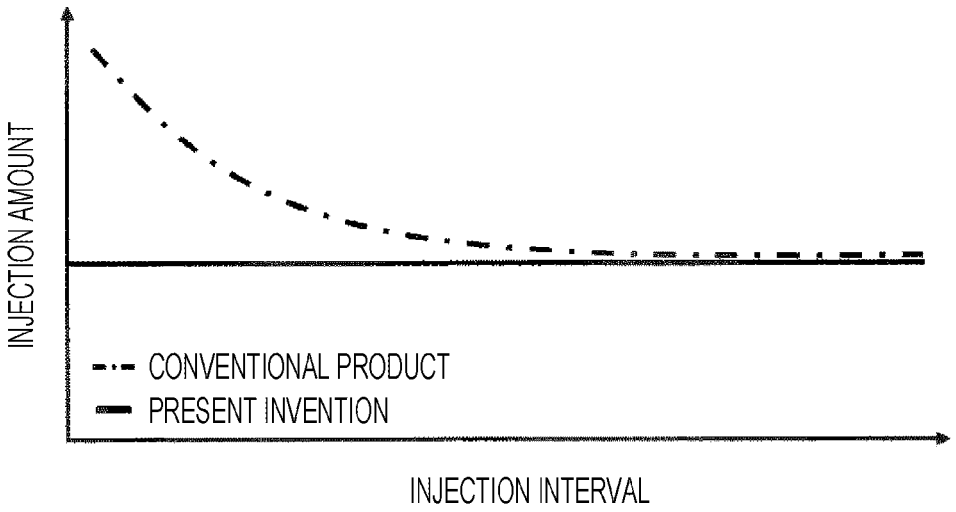
FIG. 8 is a graph showing the relationship between the injection interval and the injection amount in the fuel injection device 100 according to an embodiment of the present invention.

FIG. 8 is a graph showing the relationship between the injection interval and the injection amount in the fuel injection device 100 according to an embodiment of the present invention. As shown in FIG. 8, according to this embodiment, it is possible to suppress the variation in the injection amount caused by injection intervals, and it is possible to supply a desired injection amount to the internal combustion engine with high accuracy.

In this embodiment, in the fuel injection device 100 in which the valve body 101 receives kinetic energy from the movable iron core 106 when the valve is opened, even when the pulse interval Tint between the preceding fuel injection (first fuel injection) and the subsequent fuel injection (second fuel injection) changes, it is possible to control the valve body 101 so as to stably operate at the time of valve opening, thus promoting the stabilization of the injection amount.

The valve body 101 is opened by the first drive command pulse Pi1, and then the first drive command pulse Pi1 is cut off to cut off the energization to the coil 108 from the valve open state. As a result, the movable iron core 106 and the valve body 101 are displaced downstream. A stable injection amount can be obtained by correcting the second drive command pulse width Ti2 in accordance with the first drive command pulse width Ti1 or the pulse interval Tint between the first drive command pulse width Ti1 and the second drive command pulse width Ti2. The position of the movable iron core 106 and the remaining magnetic field, which affect stable injection, change in accordance with the first drive command pulse width Ti1 and the pulse interval Tint, and the injection amount based on the second drive command pulse width Ti2 increases or decreases depending on the position of the movable iron core 106. A stable injection amount can be obtained by correcting the second drive command pulse width Ti2 in consideration of the position of the movable iron core 106 and the remaining magnetic field. The above description has exemplified the fuel injection device 100 configured to generate a gap 218 between the movable iron core and the valve body in the valve closed state. However, even a fuel injection device configured so as not to generate the gap 218 between the movable iron core 106 and the valve body 101 can obtain effects similar to those of this embodiment as long as the movable iron core 106 and the valve body 101 are configured to be relatively displaceable.

Further, in the exemplified configuration of the fuel injection valve 100 according to this embodiment, there is no member such as a stopper on the downstream side of the movable iron core 106. However, even in a configuration in which there is a stopper member with which the movable iron core 106 contacts, the same actions and effects can be obtained, and hence this is not exhaustive.

This embodiment is configured as follows.

(1) In the control unit 120 of the fuel injection device 100 including a valve body 101 that opens the fuel passage by moving away from the valve seat, the movable iron core 106 that opens and closes the valve body 101, and the fixed iron core 107 that attracts the movable iron core 106 by passing a current through the coil 108, the control unit 120 of the fuel injection device 100 including a control part that controls the energization time of the current based on the pulse width of the drive command pulse, the control part is configured to be able to execute control to split the required fuel injection amount for one combustion cycle into portions and inject the portions in a plurality of times, and in a plurality of injections including sequence of a preceding drive command pulse Pi1 and a subsequent drive command pulse Pi2, the control part acquires a preceding drive command pulse width Ti1 of the preceding drive command pulse Pi1 and a pulse interval Tint that is the time between end time te1 of the preceding drive command pulse Pi1 and start time ts2 of the subsequent drive command pulse Pi2, and corrects the subsequent drive command pulse width Ti2 of the subsequent drive command pulse Pi2 by using the preceding drive command pulse width Ti1 and the pulse interval Tint.

(2) In (1), the control unit includes correction parts 404 to 406 that correct the subsequent drive command pulse width Ti2 when the pulse interval Tint is less than the set value Tε.

(3) In (2), the control unit holds the characteristic map (see FIG. 6) having the relationship among a preceding drive command pulse width Ti2, the pulse interval Tint, a subsequent injection amount predicted value Qpre2 based on the subsequent drive command pulse Pi2, and the second drive command pulse width Ti2' corresponding to the subsequent injection amount predicted value Qpre2, and the correction parts 404 to 406 correct the subsequent drive command pulse width Ti2, based on the information of the characteristic map.

(4) In (2), the correction parts 404 to 406 use valve closing completion time Tb1 corresponding to the preceding drive command pulse width Ti1 instead of the preceding drive command pulse width Ti1.

(5) In (4), the control unit holds the characteristic map (see FIG. 7) having the relationship among the valve closing completion time Tb1, the pulse interval Tint, the subsequent injection amount predicted value Qpre2 based on the subsequent drive command pulse Pi2, and a subsequent drive command pulse width Ti2' corresponding to the subsequent injection amount predicted value Qpre2, and the correction parts 404 to 406 correct the subsequent drive command pulse width Ti2, based on the information of the characteristic map.

(6) In (5), the control unit includes a calculation part (second injection amount predicted value calculation part) 404 that acquires a drive voltage applied to the coil 108 and calculates the inductance change of the coil 108 from the drive voltage, and a detection part 402 that detects the motion of the valve body 101 using the result of calculation by the calculation part 402, wherein the valve closing completion time Tb1 is detected based on the calculation result of the inductance change calculated by the calculation part 402.

(7) In (6), the detection part 404 detects the movement of the valve body 101 based on the subsequent drive command pulse width Ti2, and the characteristic map is updated using the valve closing completion time Tb2 of the next injection detected by the detection part 402.

In addition, the present invention is not limited to above-described embodiments and includes various modifications.

For example, the above embodiments have been described in detail for easy understanding of the present invention, and is not necessarily limited to one having all the configurations. Moreover, it is possible to add, delete, and replace other configurations with respect to part of the configurations of the embodiments.

REFERENCE SIGNS LIST

100 fuel injection device
101 valve body
106 movable iron core
107 fixed iron core
108 coil
120 engine control unit (control unit)
402 injection pulse width acquisition part (calculation part, detection part)
404 to 406 correction part
Pi1 preceding drive command pulse (first drive command pulse)
Pi2 subsequent drive command pulse (second drive command pulse)
Qpre2 subsequent injection amount predicted value based on subsequent drive command pulse Pi2
Tb1 valve closing completion time corresponding to preceding drive command pulse width Ti1
Ti1 preceding drive command pulse width (first drive command pulse width)
Ti2 subsequent drive command pulse width (second drive command pulse width)
Ti2' second drive command pulse width corresponding to the subsequent injection amount predicted value Qpre2
Tint pulse interval as time between te1 and ts2
te1 end time of preceding drive command pulse Pi1
ts2 start time of subsequent drive command pulse Pi2

The invention claimed is:

1. An apparatus comprising:

a control unit of a fuel injection device including a valve body that opens a fuel passage by moving away from a valve seat, a movable iron core that opens and closes the valve body, and a fixed iron core that attracts the movable iron core by passing a drive current through a coil, the control unit of the fuel injection device including a control part that controls an energization time of the drive current based on a pulse width of a drive command pulse, wherein the control part is configured to split a required fuel injection amount for one combustion cycle into portions and inject the portions in a plurality of times, and in a plurality of injections including a sequence of a preceding drive command pulse and a subsequent drive command pulse, the control part acquires a preceding drive command pulse width of the preceding drive command pulse and a pulse interval that is a time between an end time of the preceding drive command pulse and a start time of the subsequent drive command pulse, and corrects a subsequent drive command pulse width of the subsequent drive command pulse by using a preceding drive command pulse width and the pulse interval.

2. The apparatus according to claim 1, comprising a correction part that corrects the subsequent drive command pulse width when the pulse interval is less than a set value.

3. The apparatus according to claim 2, wherein the control unit holds a characteristic map having a relationship among the preceding drive command pulse width, the pulse interval, a subsequent injection amount predicted value based on the subsequent drive command pulse, and a second drive command pulse width corresponding to the subsequent injection amount predicted value, and the correction part corrects the subsequent drive command pulse width based on information of the characteristic map.

4. The apparatus according to claim 2, wherein the correction part uses a valve closing completion time corresponding to the preceding drive command pulse width in place of the preceding drive command pulse width.

5. The apparatus according to claim 4, wherein the control unit holds a characteristic map having a relationship among the valve closing completion time, the pulse interval, a subsequent injection amount predicted value based on the subsequent drive command pulse, and a subsequent drive command pulse width corresponding to the subsequent injection amount predicted value, and the correction part corrects the subsequent drive command pulse width based on information of the characteristic map.

6. The apparatus according to claim 5, comprising:

a calculation part that acquires a drive voltage applied to the coil and calculates an inductance change of the coil from the drive voltage, and a detection part that detects a motion of the valve body using a result of calculation by the calculation part, wherein the valve closing completion time is detected based on the calculation result of the inductance change calculated by the calculation part.

7. The apparatus according to claim 6, wherein the detection part detects a movement of the valve body due to the subsequent drive command pulse width, and the characteristic map is updated by using the valve closing completion time of the subsequent injection detected by the detection part.

* * * * *